US007965490B2

(12) United States Patent
Hummel

(10) Patent No.: US 7,965,490 B2
(45) Date of Patent: Jun. 21, 2011

(54) METHOD FOR ASSIGNING A DELAY TIME TO ELECTRONIC DELAY DETONATORS

(75) Inventor: Dirk Hummel, Hennef (DE)

(73) Assignee: Orica Explosives Technology Pty Ltd, Melbourne Victoria (AU)

( * ) Notice: Subject to any disclaimer, the term of this patent is extended or adjusted under 35 U.S.C. 154(b) by 473 days.

(21) Appl. No.: 12/084,107

(22) PCT Filed: Oct. 27, 2006

(86) PCT No.: PCT/AU2006/001619

§ 371 (c)(1),
(2), (4) Date: Apr. 25, 2008

(87) PCT Pub. No.: WO2007/051231

PCT Pub. Date: May 10, 2007

(65) Prior Publication Data

US 2009/0260532 A1 Oct. 22, 2009

(30) Foreign Application Priority Data

Nov. 2, 2005 (DE) ..... 10 2005 052 578

(51) Int. Cl.
*F42C 11/06* (2006.01)

(52) U.S. Cl. ..... 361/249

(58) Field of Classification Search ..... 361/249, 361/248; 102/202.5, 200, 215
See application file for complete search history.

(56) References Cited

U.S. PATENT DOCUMENTS

| | | | | |
|---|---|---|---|---|
| 3,913,021 | A | 10/1975 | McCarthy et al. | |
| 4,986,183 | A | 1/1991 | Jacob et al. | |
| 6,837,163 | B2 * | 1/2005 | Hallin et al. | 102/215 |
| 6,839,654 | B2 | 1/2005 | Rollig et al. | |
| 2005/0011388 | A1 * | 1/2005 | Kouznetsov | 102/200 |
| 2005/0011390 | A1 * | 1/2005 | Jennings, III | 102/202.5 |
| 2005/0183608 | A1 * | 8/2005 | Hallin et al. | 102/215 |

FOREIGN PATENT DOCUMENTS

| | | | |
|---|---|---|---|
| EP | 0055144 | B1 | 9/1985 |
| EP | 0 443 221 | A1 | 8/1991 |

* cited by examiner

*Primary Examiner* — Jared J Fureman
*Assistant Examiner* — Angela Brooks
(74) *Attorney, Agent, or Firm* — Birch, Stewart, Kolasch & Birch, LLP

(57) ABSTRACT

In the method for assigning a delay time to an electronic delay detonator. The detonator includes a data register (24) into which a desired delay time value, supplied by a controller, is written. Subsequently, over a predetermined time period (t) the contents of the data register (24) is repetitively added to a counter register (26) in which the contents is accumulated. After a division of the counter register contents through the calibration time, the contents of the counter register (26) is subsequently counted down using the same oscillator (18) which has controlled the accumulation process. The invention allows the delay time value supplied by the controller to be exactly adhered with, using an oscillator (18) of low accuracy and without feedback from the detonator (12) to the controller.

7 Claims, 2 Drawing Sheets

METHOD FOR ASSIGNING A DELAY TIME TO ELECTRONIC DELAY DETONATORS

Figure 1:
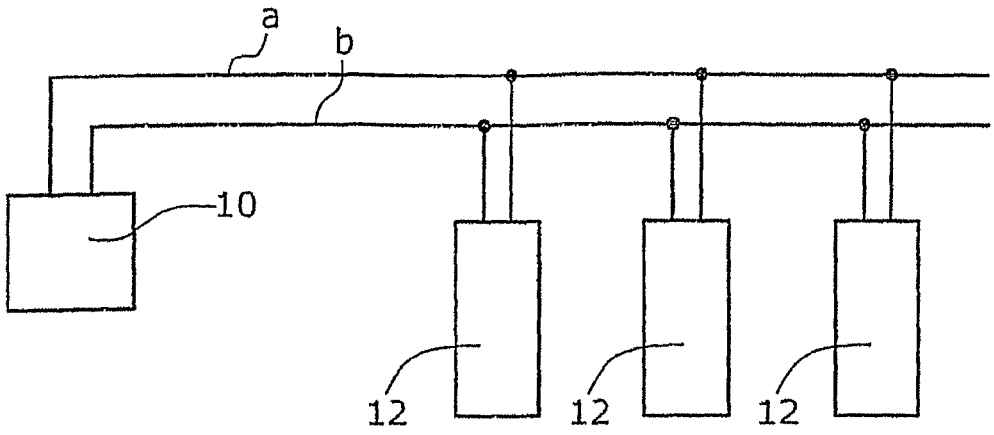

The invention relates to a method for assigning a delay time to an electronic delay detonator comprising an oscillator with the aid of a controller, and a blasting system comprising a controller and a plurality of electronic delay detonators which are connectable thereto.

Electronic delay detonators are controlled via a central controller. They are connected in parallel via a two-wire line with the controller, wherein the controller is capable of assigning an individual delay time in each explosive delay detonator. The electronic delay detonators comprise an oscillator which oscillates at a given frequency. After reception of a start signal, the oscillator pulses are counted. One problem encountered is the inaccuracy of the oscillators included in the individual electronic delay detonators. Crystal-controlled oscillators of high accuracy are not suitable for this purpose since they are on the one hand expensive and on the other hand susceptible to shocks. Therefore integrated ring oscillators or RC oscillators are normally used. These oscillators offer a relatively small absolute accuracy of the resonant frequency and thus make a calibration process necessary for obtaining the desired accuracy of the firing delay. Normally, during the calibrating process the oscillator runs for a defined time period, while a counter counts the number of clock pulses. This process can take place simultaneously for all connected electronic delay detonators. After a predetermined number of clock cycles, the individual counter reading values are read out in order to determine the number of clock pulses required for the respective counter to achieve the desired delay time. This process makes it necessary to read a counter reading value at the electronic delay detonator and to transmit the value to the controller. However the electronic delay detonators are not provided with their own stable power source, but are supplied by the controller and are merely provided with a storage capacitor. Data transmission from the electronic delay detonator to the controller is therefore inefficient and error-prone, in particular under the hard operation conditions prevailing in mines and at other locations where time-controlled blasting operations are carried out. Further, such data transmission, which must be carried out for one detonator after the other, is time-consuming. Finally, such delayed blasting is frequently carried out in disturbance-prone surroundings where disturb signals may enter the line system.

It is an object of the invention to provide a method for setting a delay time to an electronic delay detonator, which is adapted to be reliably performed and insusceptible to external disturbances.

It is another object of the invention to propose a method which allows the delay time to be accurately complied without an oscillator of high absolute accuracy being required.

It is another object of the invention to suggest a method which does not require data transmission from the electronic delay detonator to the central controller.

The method according to the invention is defined in claim 1. It comprises the following steps:

a) writing a desired delay time value into a data register, b) repetitively adding the desired delay time value to the contents of a counter register in accordance with the pulse clock of the oscillator over a predetermined time period, wherein a final value is generated in the counter register, c) dividing the final value by a quotient, which depends on the length of the time period, for obtaining an initial value for counting down the counter register to determine the delay time.

The method according to the invention allows the delay time to be set at each one of a plurality of electronic delay detonators with unidirectional communication between the controller and each electronic delay detonator. The electronic delay detonators may be provided with relatively inexpensive oscillators of simple configuration which do not offer an exactly defined absolute resonant frequency. It is however of importance that the respective frequency is constantly adhered to. This means that no essential changes in the resonant frequency of the oscillator may occur over time. Further, the method does not require any transmission of data or other signals from the individual electronic delay detonator to the controller. Thus uncertainties involved in such transmission are eliminated.

The invention allows the necessary programming time to be reduced and the amount of data to be transmitted between the controller and the detonator during the programming sequence to be minimized.

A particularly simple manner of setting the initial value for counting down the counter register is achieved when the quotient, by which the final value of the counter register is divided, is equal to the predetermined time period and has the value $2^x$, where x is a natural integer. Since the counter register is a binary register, a shift of the contents in the counter register by one bit to the right corresponds to dividing by 2. The counter register has a shift function. The desired delay time is normalized to a base unit, such as milliseconds. In this manner, dividing by the quotients 2, 4, 8, 16, 64, may be effected by a respective shift of the contents of the counter register by x bits to the right. This makes the dividing operation particularly simple. The electronic delay detonator does not require a universal microprocessor, but merely an integrated circuit configured for special tasks, i.e. a so-called state machine. This integrated circuit includes the data register, the counter register, an ID register for receiving an identification, and means for allowing communication with the controller.

The invention further relates to a blasting system comprising a controller and a plurality of electronic delay detonators connectable thereto, wherein each electronic delay detonator includes a data register into which the controller is adapted to write an individual desired delay time value, and its own oscillator. The blasting system is characterized in that the electronic delay detonator comprises a counter register which repetitively accepts and accumulates the contents of the data register in accordance with the oscillator clock over a predetermined time period, whereby a final value is obtained, and that the final value is divided by a quotient relating to the duration of the stated time period in order to generate an initial value for counting down the counter register.

Figure 2:
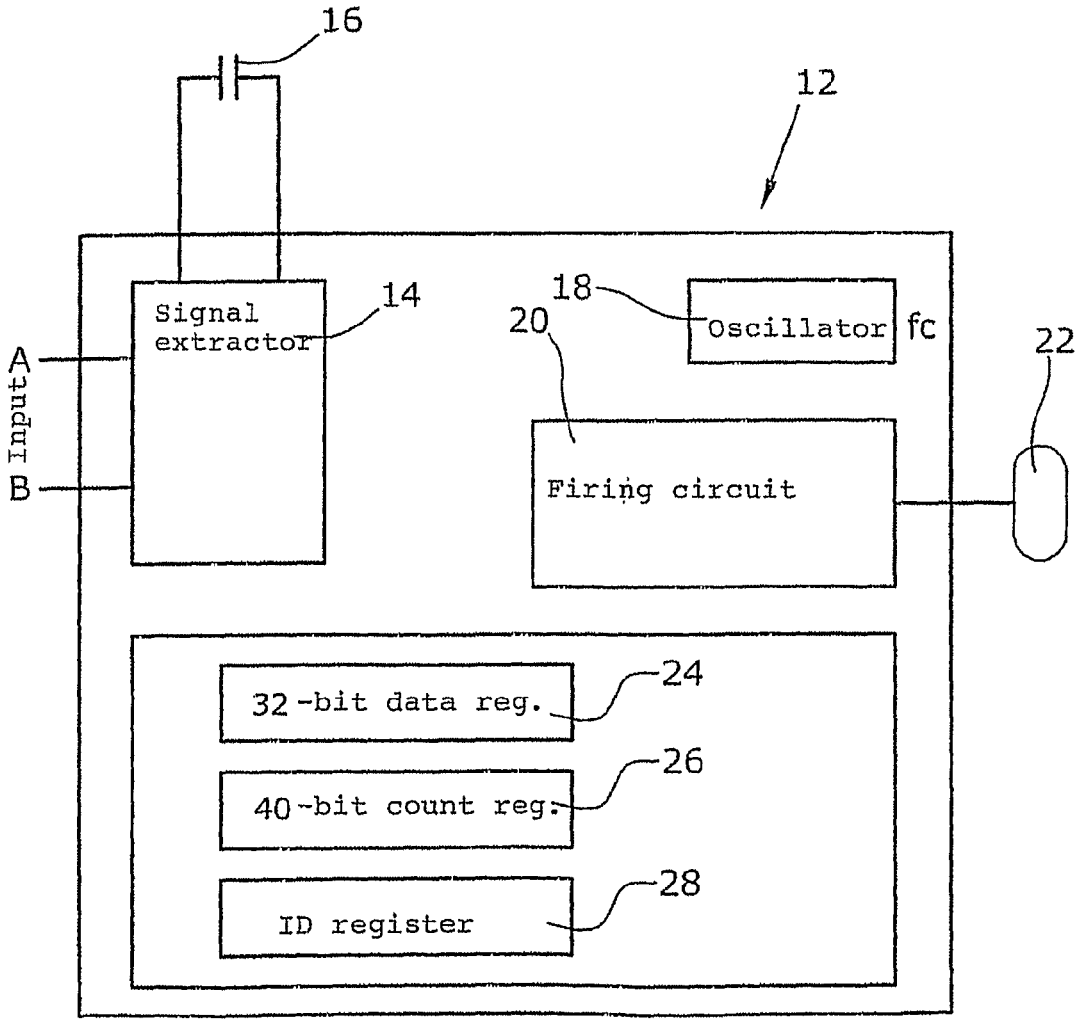
Figure 3:
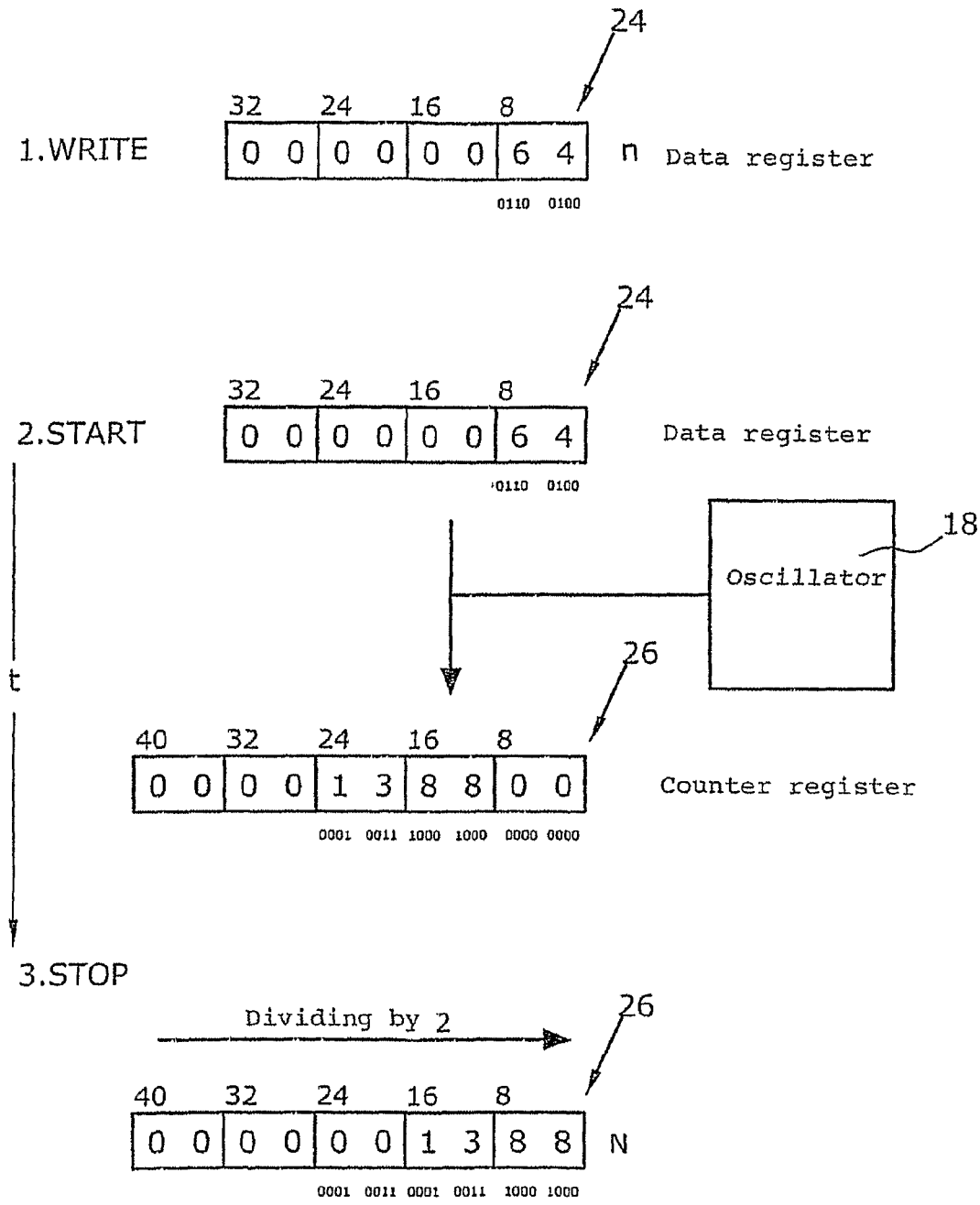

An embodiment of the invention will now be described in greater detail with reference to the drawings in which:

FIG. 1 shows a schematic representation of the blasting system comprising the controller and the electronic delay detonators, FIG. 2 shows a schematic diagram of the components Included In an electronic delay detonator, and FIG. 3 shows a schematic representation of the contents of the data register and the counter register during the individual phases of setting the delay time.

FIG. 1 shows a blasting system. The blasting system includes a central controller 10 and a plurality of electronic delay detonators 12. The controller 10 is connected with a two-wire line comprising the wires a and b to which, in parallel, the individual electronic delay detonators 12 are connected. During a blasting operation the controller 10 supplies a signal to all electronic delay detonators 12. The electronic delay detonators 12 cause the firing process to be carried out with an individual delay, wherein the supply is set by the controller at each electronic delay detonator. In this manner, a sequential firing of the electronic delay detonators is realized. The controller 10 is responsible for both the power supply and the information supply to the electronic delay detonators 12.

The circuitry of an electronic delay detonator 12 is schematically shown in FIG. 2. The electronic delay detonator includes a signal extractor 14 connected with the input terminals A and B which are connected to the wires a and b. The signal extractor 14 has connected thereto a storage capacitor 16 for the power supply of the detonator. The storage capacitor is charged by the controller 10. The signal extractor 14 extracts the pulse signals from the wires a and b, via which the controller communicates with the detonator.

The detonator 12 includes an oscillator 18 which oscillates at certain frequency. This frequency corresponds only roughly to a given frequency. Further, the detonator includes a firing circuit 20 which sets off a detonator element 22 at the specified firing time.

The detonator includes a data register 24 which in this case has a capacity of 32, bits, and a 40-bit counter register 26. The data register 24 is capable of receiving and storing a desired delay time value, which is supplied by the controller 10, from the signal extractor 14. The counter register 26 is connected with the data register 24 such that it can accept and accumulate the contents of the data register in accordance with the clock of the oscillator 18. In this manner, the desired delay time value entered into the data register can be multiplied by accumulation. The counter register 26 also is a shift register whose contents can be shifted by a clocking operation of the oscillator 18.

Finally, the detonator includes an ID register 28 in which a unique identification number is stored which exclusively identifies the respective detonator. When this ID number is retrieved by the controller 10, the respective detonator receives the subsequently supplied signals from the controller.

The data register is a read-write register. According to FIG. 3, the data register 24 is divided into four groups of 8, bits each. The data register is hexadecimally organized. Each group includes two decimal numbers. In the illustrated embodiment, the right-hand group includes the binary numbers "0110" (=6) and "0100" (=4). This results in the decimal value 100.

With the write command WRITE the controller enters the desired delay time of the respective detonator into the data register of each detonator.

Then a START command for the calibration process is given which causes the contents of the data register 24 to be accepted and added up In the counter register 26 at each clock pulse of the oscillator 18. Adding-up is continued until reception of a STOP signal for the calibration process, which is supplied by the controller. In the illustrated embodiment, upon reception of the STOP signal the counter register 26 contains the hexadecimal value 138800, which corresponds to a decimal value of 1,280,000.

The calibration time between START signal and STOP signal is a defined time period. Said time period amounts to $2^x$, ms. In the illustrated embodiment, x=8, was selected such that the calibration time is t=256, ms. This is the quotient by which the final value contained in the counter register 26 is divided to obtain the initial value N for the count down of the counter register by the oscillator.

After reception of the STOP signal the contents of the counter register 26 is shifted In accordance with the oscillator clock. This process corresponds to repetitive dividing by 2. After x dividing processes the final value is divided by $2^x$, which corresponds to the calibration time t (in ms). As a result, the counter register 26 contains the initial value N for the subsequent count down of the counter register contents to obtain the delay time d which is started by a command signal of the controller 10. In the illustrated embodiment, after dividing by 256, the counter register value amounts to the hexadecimal value of 1388, which corresponds to a decimal value of 5000.

The following calculation shall explain this, where:

n=desired delay time d=time of count down from the obtained initial value to 0 t=calibration time=$2^x$, ms $f_c$=clock frequency of the oscillator x=bits to be shifted to the right of the data register N=initial value for counting down the counter register for obtaining the desired delay time n The initial value N for counting down the counter register is determined as follows:

$$N=n*t*f_c*1/2^x$$

with t=$2^x$, the value $2^x$, is cancelled from the equation, with the following result:

$$N=n*f_c$$

During the count down the following applies:

$$d=N/f_c$$

Provided that $f_c$, is constant during calibration and count down, the following result is obtained:

$$d=n$$

Thus the time required for the count down equals the previously set desired delay time.

It is not necessary that t equals the value $2^x$. It rather suffices if t is proportional to the value $2^x$. For example, the calibration time t may also be given in tenths of $2^x$, ms; in this case, the contents of the data register is interpreted as tenths of ms.

The invention claimed is:

1. A method for assigning a delay time to an electronic delay detonator comprising a pulse clock-supplying oscillator with the aid of a controller, the method comprising:

a) writing (WRITE) a desired delay time (n) into a data register, b) repetitively adding the desired delay time (n) to the contents of a counter register in accordance with the pulse clock of the oscillator over a predetermined time period (t), wherein a final value is generated in the counter register, c) dividing the final value by a quotient ($2^x$), which depends on the length of the time period (t), for obtaining an initial value (N) for counting down the counter register to determine the delay time (d), wherein the quotient ($2^x$) equals the time period (t) and has the value $2^x$, where x is a natural integer.

2. The method according to claim 1, wherein dividing by the quotient is achieved through shifting the contents of the counter register by x bits.

3. A blasting system comprising a controller and a plurality of electronic delay detonators connectable therewith, wherein each electronic delay detonator includes a data register into which the controller writes an individual desired delay time (n), and includes its own oscillator, characterized in that the electronic delay detonator comprises a counter register which repetitively accepts and accumulates the contents of the data register over a predetermined time period (t) in accordance with the clock of the oscillator, whereby a final value is obtained, and that the final value is divided by a quotient relating to the duration of the stated time period (t) in order to generate an initial value (N) for counting down the counter register, wherein the quotient $2^x$ equals the time period (t) and has the value $2^x$, where x is a natural integer.

4. The blasting system according to claim 3, wherein dividing by the quotient is achieved through shifting the contents of the counter register by x bits.

5. The blasting system according to claim 3, wherein the electronic delay detonator receives a WRITE signal from the controller for accepting the desired delay time value (n).

6. The blasting system according to claim 3, wherein the electronic delay detonator receives a START signal from the controller for starting the accumulation.

7. The blasting system according to claim 3, wherein the electronic delay detonator receives a STOP signal from the controller for stopping the accumulation process and for shifting the counter register to the right.

* * * * *